US009664390B2

(12) United States Patent
Bernero et al.

(10) Patent No.: US 9,664,390 B2
(45) Date of Patent: May 30, 2017

(54) BURNER ARRANGEMENT INCLUDING AN AIR SUPPLY WITH TWO FLOW PASSAGES

(71) Applicant: ALSTOM Technology Ltd, Baden (CH)

(72) Inventors: Stefano Bernero, Oberrohrdorf (CH); Ennio Pasqualotto, Winterthur (CH); Ewald Freitag, Baden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 359 days.

(21) Appl. No.: 13/936,424

(22) Filed: Jul. 8, 2013

(65) Prior Publication Data

US 2014/0060060 A1 Mar. 6, 2014
US 2016/0298844 A9 Oct. 13, 2016

(30) Foreign Application Priority Data

Jul. 9, 2012 (EP) ..... 12175614

(51) Int. Cl.

| | |
|---|---|
| ***F23R 3/14*** | (2006.01) |
| ***F23R 3/12*** | (2006.01) |
| ***F23R 3/54*** | (2006.01) |
| ***F23R 3/28*** | (2006.01) |

(52) U.S. Cl.

CPC ..... *F23R 3/14* (2013.01); *F23R 3/12* (2013.01); *F23R 3/28* (2013.01); *F23R 3/54* (2013.01); *F23R 2900/03043* (2013.01)

(58) Field of Classification Search

CPC ..... F23R 3/14; F23R 3/12; F23R 3/28; F23R 3/54; F23R 2900/03043

USPC ..... 60/737, 738, 748, 751, 740, 752, 758, 60/760

See application file for complete search history.

(56) References Cited

U.S. PATENT DOCUMENTS 3,703,259 A * 11/1972 Sturgess ..... F23D 11/10 239/400
4,199,935 A 4/1980 Hakluytt
4,651,534 A 3/1987 Stroem
(Continued)

FOREIGN PATENT DOCUMENTS

CN 1467407 A 1/2004
DE 196 15 910 10/1997
(Continued)

OTHER PUBLICATIONS

Communication Pursuant to Article 94(3) EPC issued Feb. 15, 2017, by the European Patent Office in corresponding European Patent Application No. 13 175 489.7 (4 pages).

*Primary Examiner* — Steven Sutherland
(74) *Attorney, Agent, or Firm* — Buchanan Ingersoll & Rooney PC

(57) ABSTRACT

The invention refers to burner arrangement for producing hot gases to be expanded in a gas turbine, including a burner inside a plenum, where the burner has means for fuel injection, means for air supply and means for generating an ignitable fuel/air mixture inside the burner, and a combustion chamber following downstream said burner having an outlet being fluidly connected to the gas turbine. The invention is characterized in that the means for air supply includes at least two separate flow passages, and that the one of the two flow passages is fed by a first supply pressure and the other flow passage is fed by a second supply pressure.

15 Claims, 7 Drawing Sheets

(56) References Cited

U.S. PATENT DOCUMENTS

| | | | | | |
|---|---|---|---|---|---|
| 5,235,813 | A * | 8/1993 | McVey | F23R 3/12 | 431/181 |
| 5,351,477 | A * | 10/1994 | Joshi | F23C 7/004 | 239/400 |
| 5,490,378 | A * | 2/1996 | Berger | F23R 3/26 | 60/39.23 |
| 5,765,376 | A * | 6/1998 | Zarzalis | F23R 3/10 | 60/748 |
| 2011/0203287 | A1 | 8/2011 | Chila et al. | | |

FOREIGN PATENT DOCUMENTS

| | | |
|---|---|---|
| JP | H09-196377 | 7/1999 |
| JP | 2002-322915 | 11/2002 |
| JP | 2007-132548 | 5/2007 |
| JP | 2010-197039 | 9/2010 |
| JP | 2011-074802 | 4/2011 |
| KZ | 19620 A | 6/2008 |
| RU | 2200903 C2 | 3/2003 |

* cited by examiner

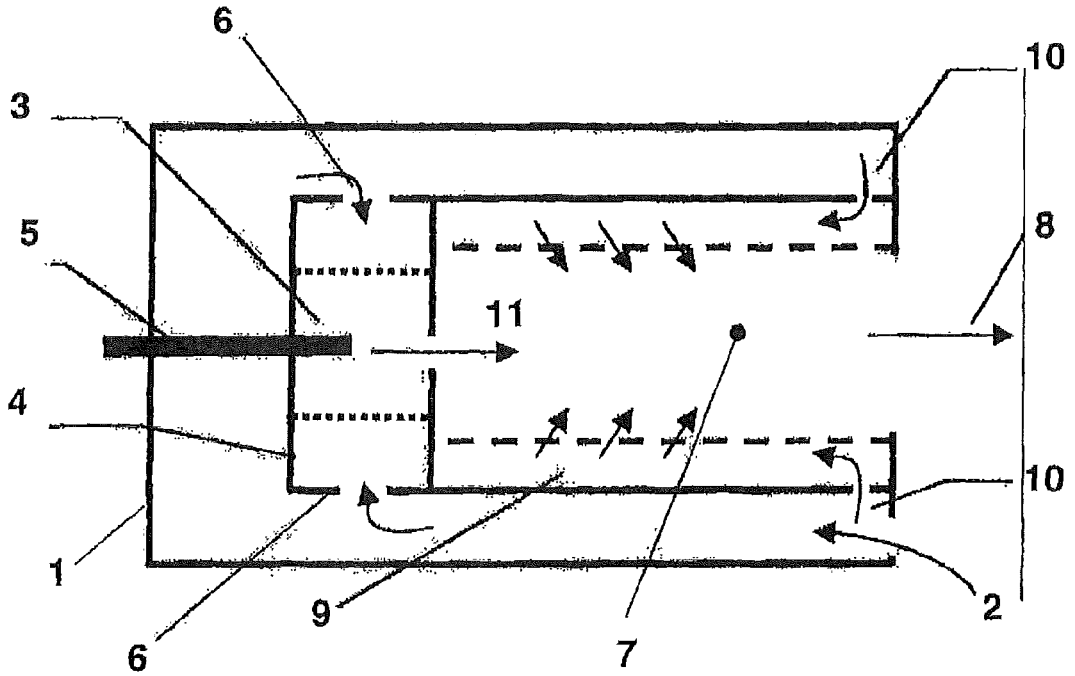
Fig. 2A (State of the art)
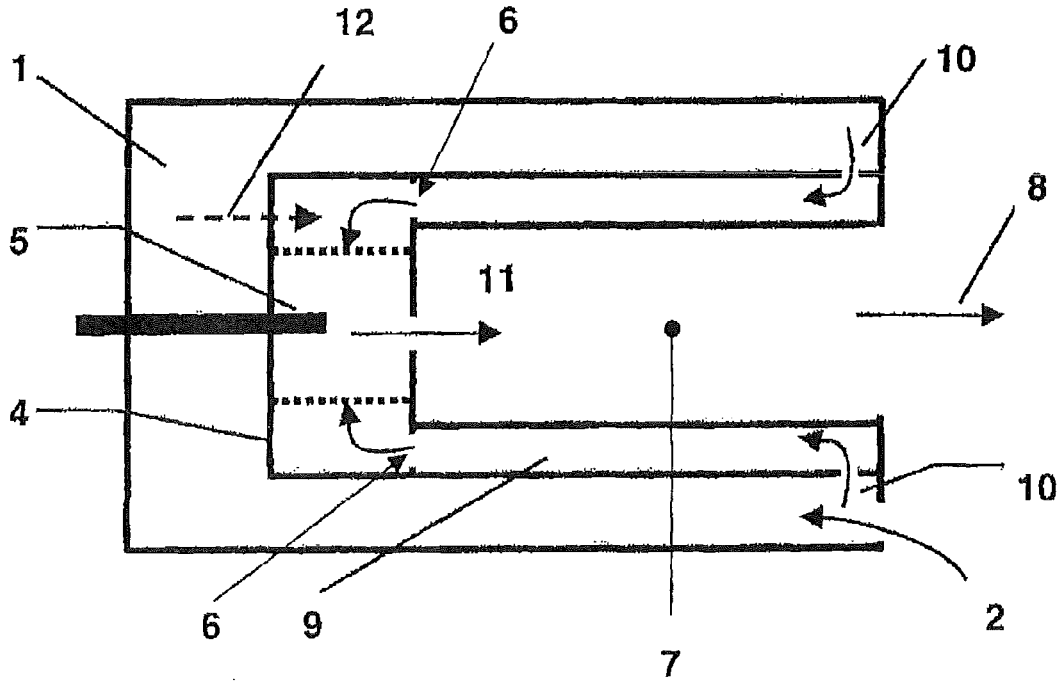
Fig. 2B (State of the art)

BURNER ARRANGEMENT INCLUDING AN AIR SUPPLY WITH TWO FLOW PASSAGES

CROSS-REFERENCE TO RELATED APPLICATIONS

This application claims priority to European Application 12175614.2 filed Jul. 10, 2012, the contents of which are incorporated herein in its entirety.

TECHNICAL FIELD

The present invention relates to the field of stationary gas turbines, especially to a burner arrangement for producing hot gases to be expanded in a turbine, comprising a burner inside a plenum, said burner has means for fuel injection, means for air supply and means for generating an ignitable fuel/air mixture inside the burner, and a combustion chamber following downstream said burner having an outlet being fluidly connected to the gas turbine.

BACKGROUND

In the development of gas turbines, both, an increased cycle performance and reduced pollutant emissions are key targets to minimize the environmental impact as well as maximize the economic benefit. In order to increase gas turbine efficiency, it is important that both the distribution of the air exiting the compressor and the distribution of the hot gases exiting the combustor are optimized, i.e. that the working fluid experiences the smallest possible pressure drop before it starts to expand in the turbine.

The before goals may be achieved inter alia by arranging a cooling path for the combustor walls and the burner air path in parallel which is illustrated in FIG. 2*a*. Concerning FIG. 2*a* a rough sketch of a burner arrangement is illustrated comprising a plenum 1 which is fluidly connected with a compressor stage of an stationary gas turbine (not shown), so that the volume of the plenum 1 is filled with compressed air 2 under a prevailing pressure p1. The plenum 1 encapsulates a burner arrangement comprising a burner section 3 which is surrounded by a burner hood 4 having means for fuel injections 5, means for air supply 6 and means for generating a fuel/air mixture (not shown) which is ignited inside a combustion chamber 7 following downstream of the burner section 3. Hot gases 8 which are produces inside said combustion chamber 7 exiting said burner arrangement directly into a turbine (not shown) for performing work by expanding. To avoid any thermal overloading of the burner arrangement especially of the combustor, the combustor wall provides a combustor liner containing an interspace 9 into which compressed air 2 form the plenum 1 respectively form the compressor enters the interspace 9 for cooling purpose. The interspace 9 represents a cooling air path to cool the combustor walls. The cooling air emits the cooling air path and enters the combustion chamber directly. Also a part of compressed air inside the plenum 1 enters the burner section 3 via the means for air supply in form of access openings 6 inside the burner hood 4 for mixing with fuel which is injected by the injection means 5 for generating an ignitable fuel/air mixture 11.

The drawback of such a system is however the fact that not all of the air which is fed by the compressor inside the plenum takes part into the combustion, therefore a higher flame temperature is achieved for the same hot gas temperature, with the consequence of higher NOx emissions. Alternatively, if the layout is targeting lower NOx, the hot gas temperature has to be reduced, thereby negatively impacting engine efficiency.

An alternative System is often used, in which the cooling and burner air paths are connected in series, see FIG. 2 *b*. FIG. 2 contains same reference signs which label components already explained in FIG. 2*a* so that for avoiding repetitions these components are not explained again. Here, the cooling path for the combustor which is the interspace 9 is fluidly connected with the burner section 3, so that the cooling air enters the burner via means for air supply 6 to be mixed with fuel for generating the fuel/air mixture 11.

This has the advantage that the whole air massflow takes part into the combustion, therefore emissions are minimized, however the overall pressure loss may be higher in this case, and therefore efficiency is lower. With such a layout, the pressure loss of the cooling path can optionally be reduced by bypassing some of the air 11 directly from the plenum 1 to the burner hood 4. The bypass air 11 is, however, still experiencing a pressure loss and thereby providing no additional benefit.

SUMMARY

It is an object of the invention to provide burner arrangement for producing hot gases to be expanded in a gas turbine, comprising a burner inside a plenum, said burner has means for fuel injection, means for air supply and means for generating an ignitable fuel/air mixture inside the burner, and a combustion chamber following downstream said burner having an outlet being fluidly connected to the gas turbine, which enables operation at higher temperatures and at the same time achieving a reduction of NOx, CO emissions and lessening pressure drop problems.

The object is achieved by the sum total of the features of claim 1. The invention can be modified advantageously by the features disclosed in the sub claims as well in the following description especially referring to preferred embodiments.

The inventive idea bases on the combination of the advantages of both known air distribution layouts as explained in FIGS. 2*a* and *b* and avoid the respective drawbacks by making use of a burner arrangement according to the features of the preamble of claim 1 characterized by two separate flow paths for the combustion air, i.e. the means for air supply into the burner comprise at least two separate flow passages, in which one of the two flow passages is fed by a first supply pressure and the other flow passage is fed by a second supply pressure.

In fact in an preferred embodiment of the burner arrangement the at least one of the two flow passages is fluidly connected to the plenum in which the first pressure prevails which is fluidly connected to a compressor and the other flow passage is fluidly connected to an interspace in which the second pressure prevails and which is bordered by a combustor liner having at least one fluidly access to the plenum. Both passages end in the burner section so that the whole amount of air fed through both passages is mixed with the fuel for forming the fuel/air mixture before being ignited within the combustion chamber.

The way of feeding the air through each passage can be performed in two different ways, i.e. in series or parallel to the cooling air path which corresponds to the interspace within the combustion liner for cooling the combustion walls. In case of a series air flow a part of the compressed air inside the plenum enters via access openings the interspace of the combustion liner to cool the combustion wall first before entering the burner region via one of the flow passages for being mixed with the fuel. While passing the access openings for entering the interspace of the combustion liner the air for cooling the combustor experiences a pressure drop so that inside the combustion liner a flow pressure of $p_2$ prevails which is less than $p_1$. In case of a parallel air flow another part of compressed air inside the plenum enters the burner via the other low passage directly without cooling the combustor walls significantly. So dividing the flow of combustion air entering the burner for producing the fuel/air mixture into at least two separate flow paths enables the possibility that one flow path is fed in parallel to the cooling air path and the other one in series to it simultaneously.

Both flow passages are designed preferably such that one of the two flow passages is an outer flow passage which surrounds the other flow passage, which is a so called inner flow passage. In case of an axis symmetric burner the inner and outer flow passages are coaxial and each flow passage has a flow exit plane which is at the downstream end of each flow passage such that the exit plane of the inner flow passage is different, preferably upstream of the exit plane of the outer flow passage.

Optionally, each flow passage may contain a flow swirler, which may differ between the inner and outer flow path, so that vorticity which is induced into the both flows can be adjusted separately for the purpose of an enhanced mixture process downstream with the injected fuel.

The means for fuel injection can be designed and arranged in different style and at different locations. One preferred means for fuel injection concerns a fuel lance extending in or through the inner flow passage. Alternatively to or in combination with said fuel lance further means for fuel injection can be arranged like fuel ejecting nozzles which are allocated at the downstream edge of the channel wall encircling the inner flow passage, i.e. the at least one fuel nozzle is placed at the exit plane of the inner flow passage. Of course other techniques for fuel injection can be applied to the inventive burner arrangement smoothly.

A further advantage feature to enhance the flow characteristic downstream of the inner passage is a lobed design of the exit rim of the channel wall encircling the inner flow passage. More details are given in combination with the following illustrated embodiments.

BRIEF DESCRIPTION OF THE FIGURES

The invention shall subsequently be explained in more detail based on exemplary embodiments in conjunction with the drawings. In the drawings

DETAILED DESCRIPTION

Figure 1:
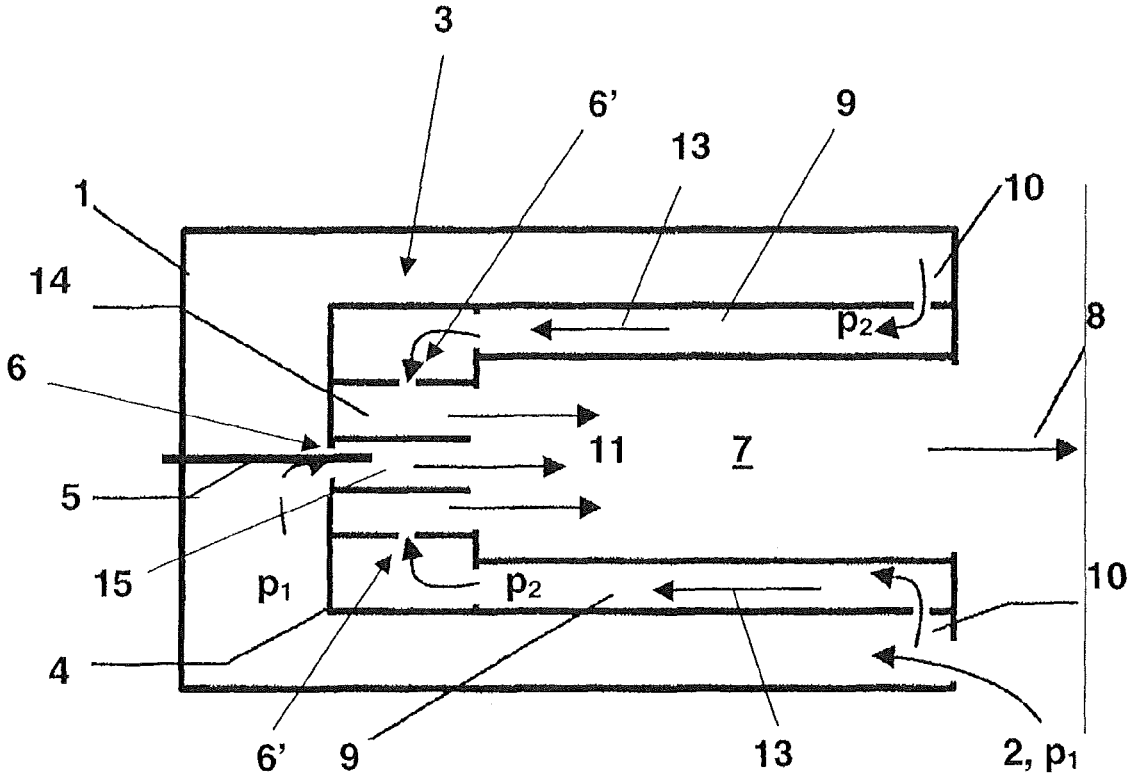
FIG. 1 shows an inventive burner arrangement with double air passage for combustor air, FIG. 2*a, b* show state of the art burner arrangement with a) parallel air cooling flow and b) with serial air cooling flow.

FIG. 1 shows a schematically longitudinal section of a burner arrangement comprising a plenum 1 which is fluidly connected with a compressor stage of an stationary gas turbine (not shown), so that the volume of the plenum 1 is filled with compressed air 2 under a prevailing pressure pi. The plenum 1 encapsulates a burner arrangement comprising a burner section 3 which is surrounded by a burner hood 4 having means for fuel injections 5, means for air supply 6, 6' and means for generating a fuel/air mixture which is ignited inside a combustion chamber 7 following downstream of the burner section 3. Hot gases 8 which are produces inside said combustion chamber 7 exiting said burner arrangement directly into a turbine (not shown) for performing work by expanding. To avoid any thermal overloading of the burner arrangement especially of the combustor, the combustor wall provides a combustor liner containing an interspace 9 into which compressed air 2 from the plenum 1 respectively form the compressor enters via access openings 10 into the interspace 9 for cooling purpose. Due to drop of pressure caused by the access openings the pressure $p_2$ inside the interspace 9 is smaller than $p_1$. The interspace 9 encloses a cooling airflow 13 to cool the combustor walls. After passing the interspace 9 in flow direction the cooling air flow 13 enters through openings 6', which serves as means for air supply into an outer flow passage 14 which is closed at an upstream end (left hand side of the figure) and opens into the combustions chamber 7 at its downstream end. The outer flow passage, which is radially encircled by a preferably cylindrical shaped wall in which the openings 6' are arranged, encloses an inner flow passage 15. The inner flow passage 15 is fluidly connected with the plenum 1 and opens into the combustion chamber 7. The outer and inner passages 14, 15 are arranged and designed coaxially and represent a double combustor air burner arrangement. The inner flow passage 15 enables a direct flow of compressed air from the plenum 1 into the burner section 3 under a pressure $p_1$. The outer flow passage 14 enables entering the cooling air flow 13, which cools the combustor wall first, into the burner section 3. So both air flows ejecting from the inner and outer flow passage 14, 15 are mixed with fuel for generating the fuel/air mixture 11 which is ignited and burned in the combustion chamber 7 for producing hot gases 8 for powering the turbine stage downstream of the combustion chamber (not shown).

Figure 3:
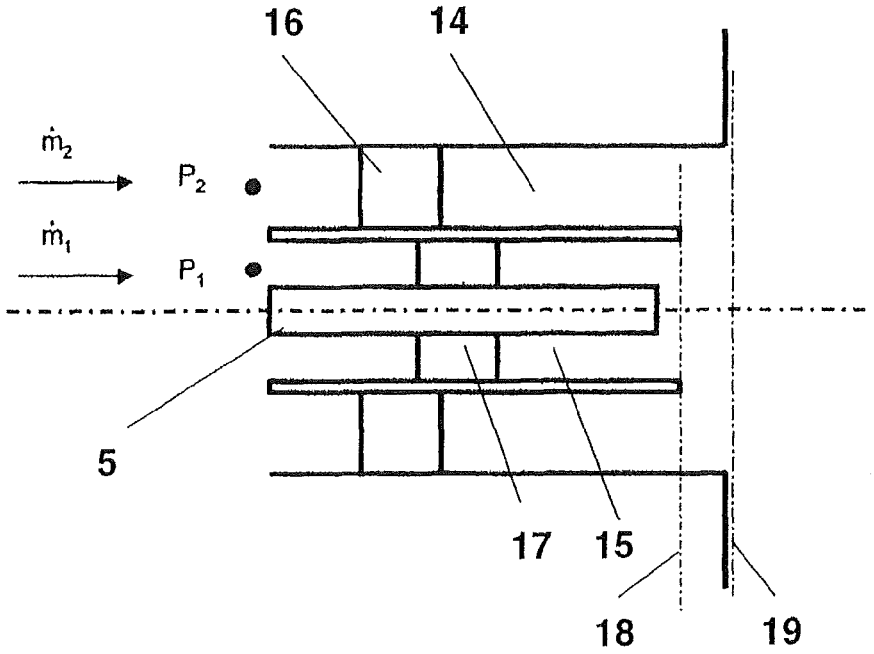
FIG. 3 shows a sketch of the proposed double air passage concept, FIG. 4*a, b* show preferred embodiments a) with serial outer passage and parallel inner passage, b) with parallel outer passage and serial inner passage.

The principle for such the double air passage burner is shown in FIG. 3. The outer flow passage, fed by a supply pressure $p_2$, which is the pressure inside the interspace 9 of the combustor liner, surrounds the inner flow passage 15, fed by a supply pressure $p_1$, which is the pressure inside the plenum 1. The mass flows $m_1$ and $m_2$ through the two flow passages are different preferably and can be adjusted suitably.

Optionally, each flow path 14, 15 can be equipped with swirler 16, 17, which may differ between the inner and outer flow path 14, 15 respectively. The inner flow path 15 contains a bluff body for fuel injection 5 which can be also a means for flow stabilization. The exit plane 18 of the inner flow passage 15 may differ from the exit plane 19 of the outer flow passage 14 and, in particular, may be located upstream of the exit plane 19 of the outer flow passage 14.

In case of an axis symmetric burner arrangement, where the two flow passages, i.e. outer and inner flow passage 14, 15, are coaxially arranged, two basic layout options are proposed.

Figure 4A:
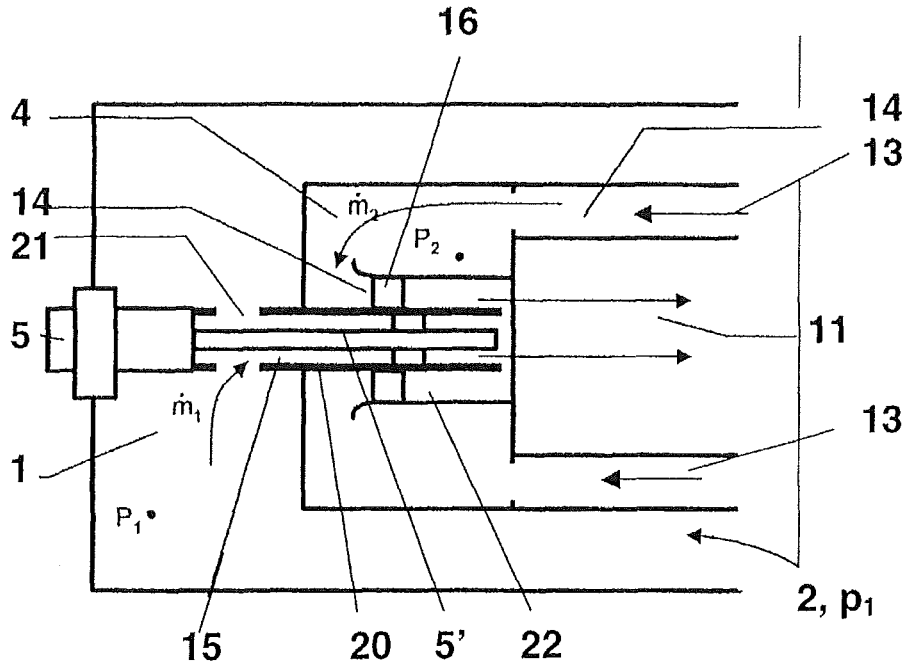

FIG. 4*a* shows an embodiment in which the outer flow passage 14 is serially fed by the combustor cooling air 13 and the inner flow passage 15 is fed directly with compressed air from the plenum 1 parallel to it. Here it is assumed that the means for fuel injection 5 is also part of a flange to a gas turbine casing (not shown) which provides a fuel lance 5' extending mostly through the whole inner flow passage 15. At an upstream portion of a channel wall 20 which encircles the inner flow passage 15 an opening 21 is provided through which the compressed air from the plenum 1 enters the inner flow passage 15. Inside the inner flow channel 15 a swirler 17 is arranged.

The inner flow channel 15 is partially surrounded by the outer flow channel along its axis which itself is radially encircled by a channel wall 22. Both channel walls 20, 22 are cylindrical in shape and arranged coaxial along one and the same burner axis. Along the outer flow channel swirler 16 are arranged also. As depicted in FIG. 4*a* the flow pressure $p_1$ and the flow mass $m_1$ of the air flow entering the inner flow passage 15 which is directed parallel to the cooling air flow 13 are different to those $p_2$, $m_2$ of the cooling air flow 13 when entering the outer flow passage 14.

Figure 4B:
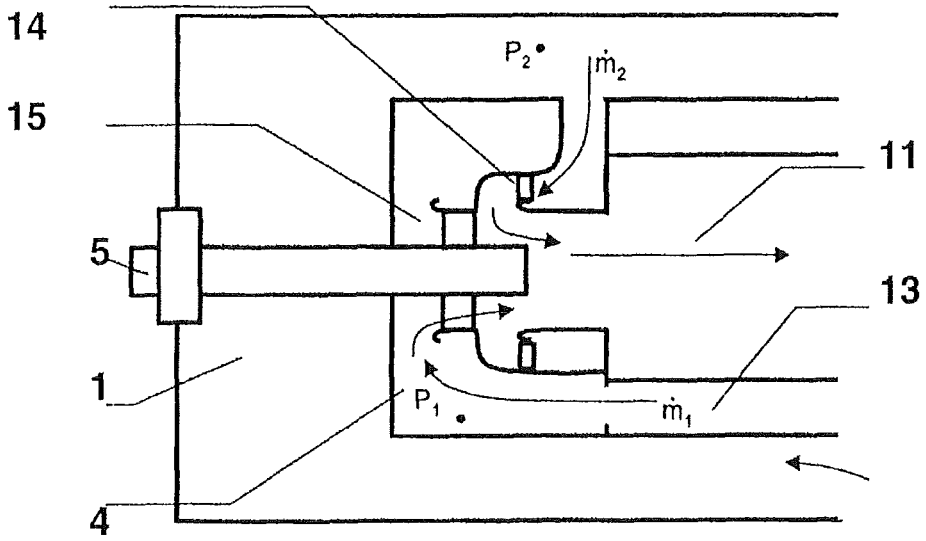
Figure 5:
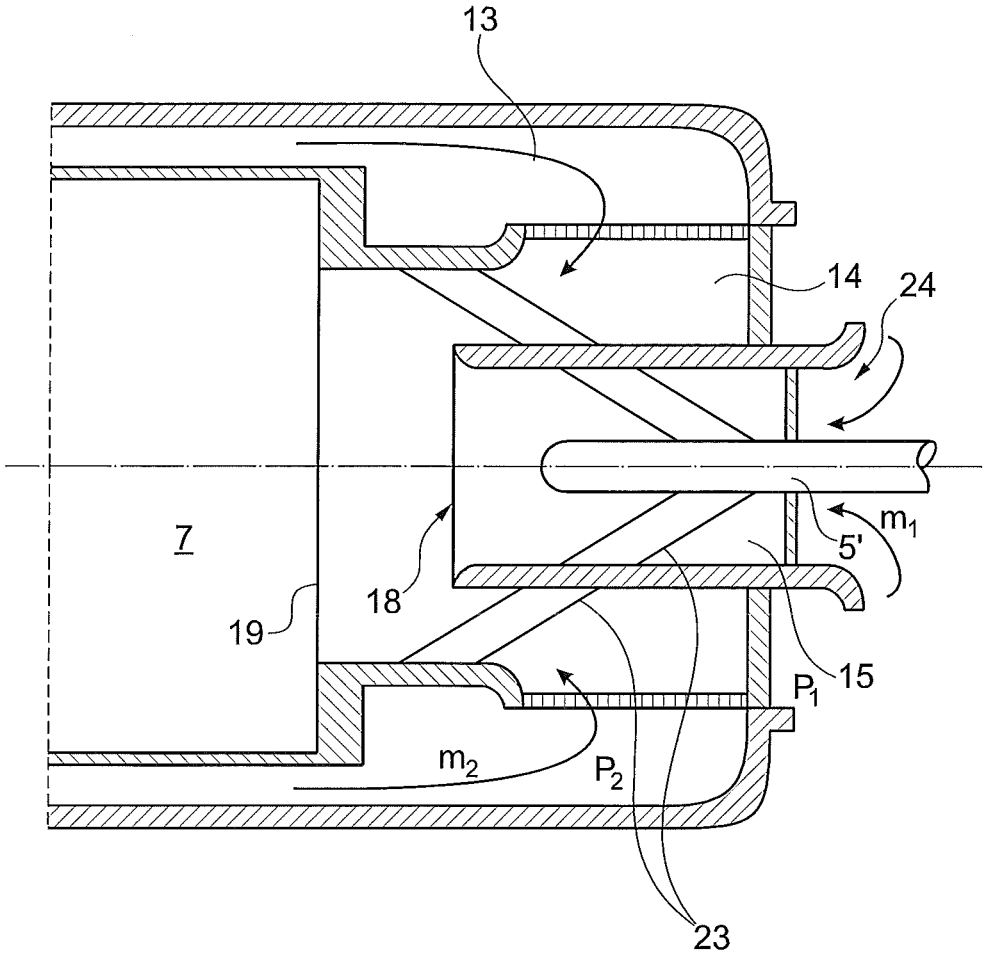
FIG. 5 shows inventive burner with serial outer passage and parallel inner passage, based on a conical swirler.

FIG. 4*b* shows an embodiment in which the outer flow passage 14 is parallel fed by the compressed air from the plenum 1 and the inner flow passage 15 is fed serially fed by the combustor cooling air 13. The burner hood 4 encloses the inner region of the burner and separates the volume of the plenum form the FIG. 5 shows a sectional view of a burner arrangement with double air passage, containing a serial outer flow passage 14 and a parallel inner flow passage 15, based on a conical swirler 23. Same as in all other illustrated embodiments the burner arrangement is enclosed by a plenum not shown. The inner flow passage 15 is fed with compressed air entering the upstream opening 24 under pressure $p_1$ and with a mass flow $m_1$. Further a fuel lance 5' extends into the inner flow passage 15 which injects fuel into the air flow swirled by the conical swirler 23. Further the cooling air flow 13 enters the outer flow passage 14 after having cooled the combustor wall and getting swirled also by the conical swirler 23 while passing the outer flow passage 14. So the air/fuel mixture which is produced along the inner flow passage 15 will be mixed after passing the exit plane 18 with the swirled additional air inside the outer flow passage 14. The additional swirled air in the outer flow passage has a lower pressure $p_2$ and another mass flow $m_2$ so that mixture efficiency can be optimized within the outer flow passage 14 by adjusting p2 and m2 suitably for getting a completely and homogenously mixed fuel/air mixture before passing the exit plane 19 of the outer flow passage.

Figure 6:
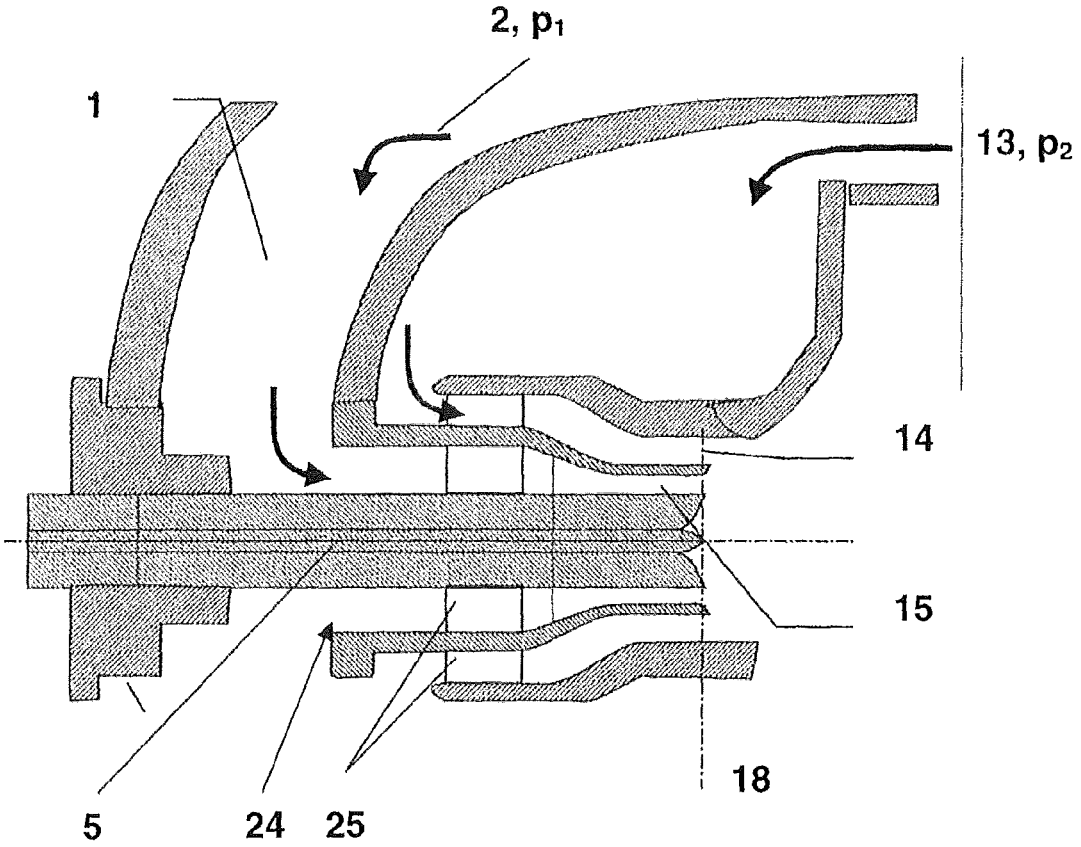
FIG. 6 shows inventive burner with serial outer passage and parallel inner passage, based on an axial swirlers.

FIG. 6 shows a sectional view of a burner arrangement with double air passage, containing a serial outer flow passage 14 and a parallel inner flow passage 15, based on an axial swirler 23. Same as in all other illustrated embodiments the burner arrangement is enclosed by a plenum 1. The inner flow passage 15 is fed with compressed air entering the upstream opening 24 under pressure $p_1$ and with a mass flow $m_1$. Further a fuel lance 5' extends into the inner flow passage 15 for injecting fuel into both air flows each swirled by the conical swirler 23. Fuel injection into both air flows takes place simultaneously at the exit plane 18 of the inner flow passage, at which both swirled air flows meet.

Figure 7:
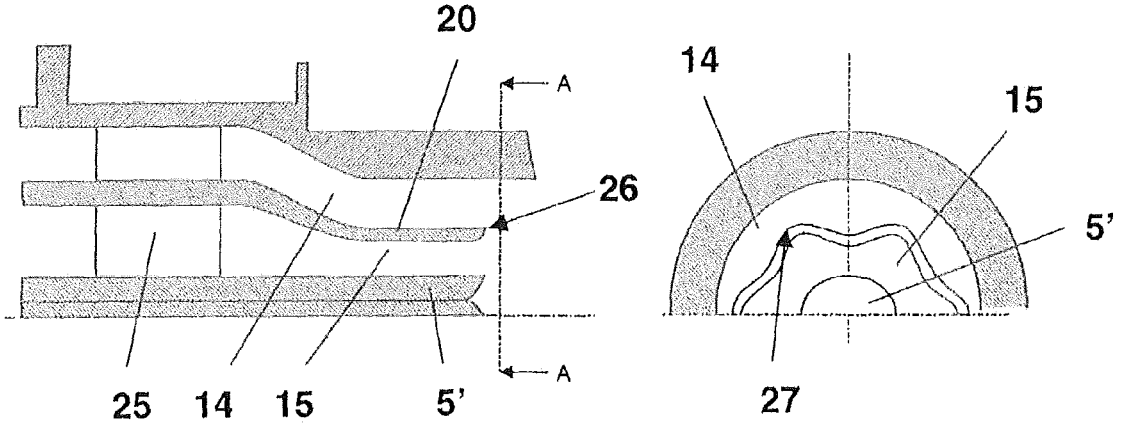
FIG. 7 shows a partial view of a longitudinal section of an inventive double flow passages with a lobed mixing edge.

In a preferred embodiment shown in FIG. 7*a, b* the inner flow passage 15 is surrounded by a channel wall 20 which has an axial downstream edge 26 providing a lobed shape 27 (see FIG. 7*a*) which can be seen from the cross section illustrated in FIG. 7*b*. Such lobed contour 27 is particularly suited for highly reactive fuels.

Figure 8:
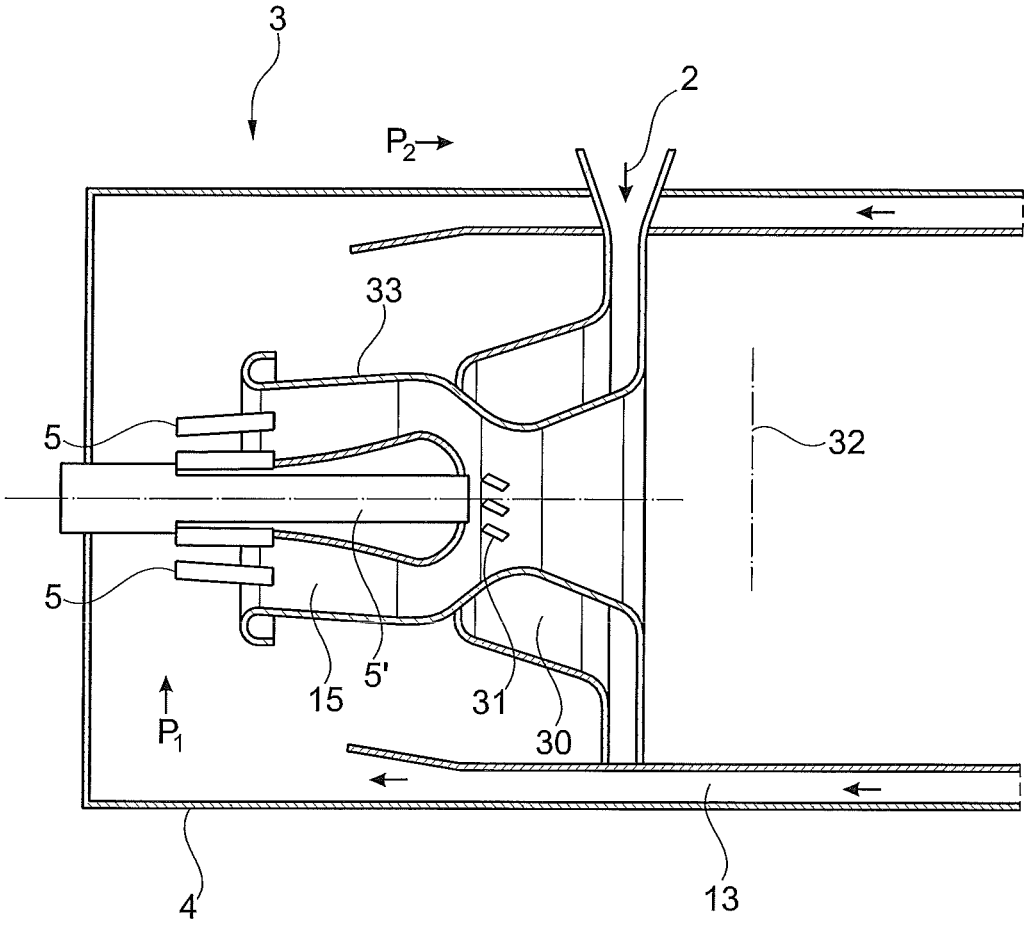
FIG. 8 shows a cutaway view of an inventive burner arrangement with double air passage of parallel outer passage and serial inner passage.
Figure 9:
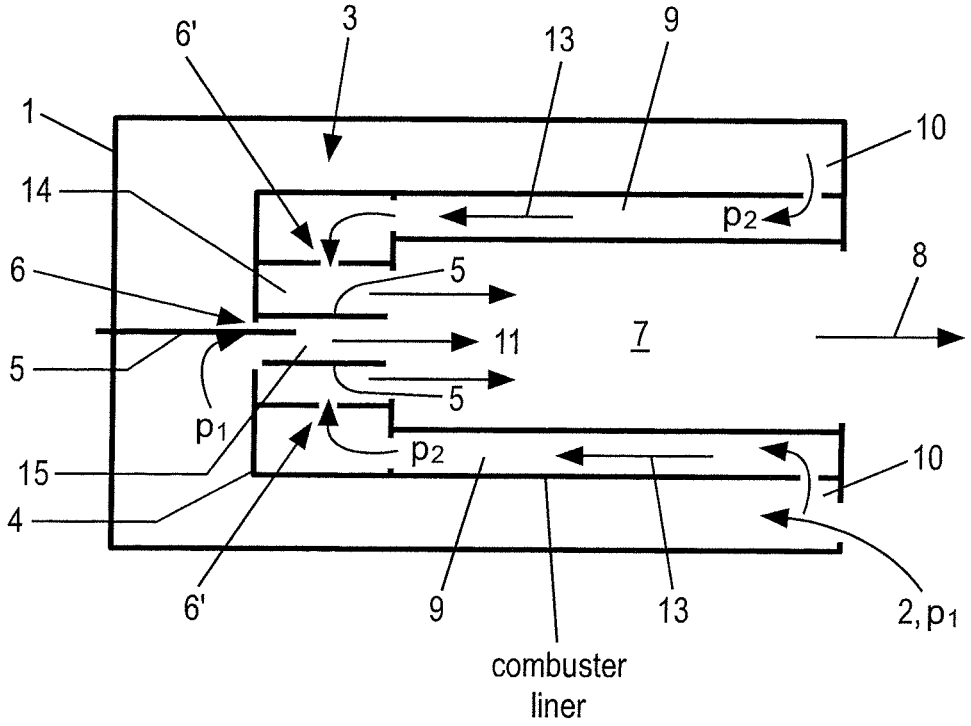
FIG. 9 shows the means for fuel injection at the axial downstream edge of the channel wall surrounding the inner flow passage and specifies the combustor liner.

FIG. 8 shows a burner arrangement according to the concept shown in FIG. 4*b*. The burner is encapsulated in a burner hood 4. The cooling air flow 13 passing through the interspace 9 of the combustion liner enters the burner section inside the burner hood 4 after having cooled the combustor walls. The air flow then flows in series into the inner flow passage 15 through an entrance opening 28 at which several fuel injectors 5 are arranged. The serial air flow and the fuel are flowing in axial direction through the inner flow passage 15 and initially mixing only due to the fuel jet spreading. The axial fuel injection arrangement also allows to concentrate the fuel injection part of the burner on an extractable lance 5' and to thus separate from the burner aerodynamics.

In addition, the fuel injection location can be adjusted axially. The fuel injection in co-flow direction yields weaker oscillations of the fuel jets and thus leads to higher flame stability.

The compressed air flow 2 is arranged in parallel and is fed directly from the plenum 1 at pressure $p_2$. This compressed air flow 2 crosses the first cooled air flow 13 in separate flow channels arranged alternatively and then flows along the surface of the combustor front panel 29 in order to cool the front panel 29 convectively. Then the compressed air flow 2 flows around the burner diffuser part 30 and acquires angular momentum in circumferential direction of the burner. Finally the air flows through a number of elongated air slots 31 into the inner part of the burner, merging with the primary air stream and introducing swirl to the overall burner flow. The mixing of the secondary compressed air flow 2 with the first flow of air 13 and fuel occurs over a very short distance such that the overall mixture is sufficiently premixed before reaching the flame zone 32 which extends downstream of the burner and can reach as much upstream as the extend of the central bluff body 33. In order to further enhance the mixing before the flame anchoring position 32, the central body 33 could also be extended further downstream. An additional fuel injection in the outer fuel passage could provide additional fuel premixing and potential for lower emissions.

The advantages of the inventive new burner concept can be summarized as follows:

- Potential for low emission operation at high hot gas temperature by avoiding air bypassing the burner like in case of the burner illustrated in FIG. 2*a*.
- Reduced overall combustor pressure drop by optimizing the air split between the two inventive flow passages.
- Potential for improved pulsation behavior by thermoacoustically decoupling the two flow passages.
- Potential for having different flow characteristics. e.g. swirl, turbulence level, in the two flow passages to better cope with different operating conditions (e.g. bad) or other boundary conditions (e.g. fuel type, fuel composition).
- The high pressure drop available for one of the two flow paths may be used as best suitable, e.g. for improving fuel mixing, for imparting higher swirl and achieve better flow stabilization, for achieving high velocity and avoid flashback for highly reactive fuels.

The interface region where the two flow streams merge can be designed to optimize different parameters, e.g. mixing between the two air streams and fuels, flame stabilization, flashback safety.

The mechanical parts creating and providing fuel to the two air passages may be separate from each other and, through modular design, allow easier change of configurations (e.g. for different fuels) as well as simpler design and improved manufacturing, assembly, inspection, and reconditioning.

With respect to the proposed layouts described in FIGS. 4*a* and *b*, additional benefits of the first concept, see FIG. 4*a*, are:

Reduced first and life cycle costs through simple design, because main parts may be formed by concentric tubes.

Further reduced pressure drop by allowing inflow in the two passages over a large cross section and with the minimum requirement of flow turns Additional benefits of the second concept, see FIG. 4*b*, are:

Efficient use of compressor exit pressure to cool combustor front segment and burner front face, possibly by convective cooling Possible further embodiments of the inventive concept are:

Application to can, annular, or silo combustors

Swirlers of different types (no swirl, axial, radial, conical swirlers, or combinations thereof for the different flow passages Two coaxial flow passages or more, e.g. one serial to liner cooling, one serial to front segment cooling, one parallel to both)

Non-coaxial flow passages (e.g. splitting flow path from inner and outer liner cooling air)

Modular variants where one of the flow passages is fixed and the other one is optimized either for standard (NG, wet oil) or highly reactive fuels (H2-rich, dry oil), respectively, thereby allowing increased fuel flexibility with minimum hardware changes Modular variants where the outer wall of the outer flow passage is connected to the front segment, while all fuel supply occur through the parts forming the central flow passage, thereby allowing air leakages between burner and front segment and increased design simplicity and robustness by having a smaller, retractable central body only Variable air flow split between the different flow passages to be adjusted, e.g. by exchangeable sieves of different open area Different fuel injection schemes combined with the different geometries/swirler types: cross-flow from inner/outer/intermediate walls, in-line injection from swirler or flow separating parts, from central/additional fuel lance(s)

Different and adjustable fuel flow split between the two passages

In order to minimize thermoacoustic pulsation, it is known that a large time lag spread between the position of the flame and those of the originating points for the different flow disturbances and/or fuel injections is beneficial.

The current burner concept is particularly suitable for this purpose, since swirl generators, fuel injection positions, and bulk flow velocities can be kept different for the different flow passages, thereby maximizing the time lag spread Similarly, it could be convenient to place the tip of the central lance, the downstream edge of the separating wall between the two passages, and the burner exit edge at different axial positions In case of coaxial air passages, the downstream edge of the separating wall between the two passages can have a lobed shape arid optionally include the fuel injection holes. The advantages thereby are.

Improved mixing with minimum pressure drop (possibility of keeping high bulk flow velocity and reduce flashback risk)

Minimum flow disturbances through absence of strong flow turns (reduce flashback risk)

Minimum flow disturbances through possibility of in-line injection from trailing edge (reduce flashback risk)

This is, in particular, suitable for highly reactive fuels and could be realized within a burner concept as shown in FIGS. 7*a* and *b*.

What is claimed is:

1. A burner arrangement for producing hot gases to be expanded in a gas turbine, comprising:

a burner inside a plenum, said burner has means for fuel injection, means for air supply and means for generating an ignitable fuel/air mixture inside the burner;

a combustion chamber following downstream of said burner having an outlet being fluidly connected to the gas turbine;

a combustor liner arranged between the combustion chamber and a combustor wall and wherein the means for air supply comprise at least two flow passages which are separate, wherein one of the at least two flow passages is fluidly connected to the plenum and is configured to be fed by a first supply pressure and an other flow passage is configured to be fed by a second supply pressure, wherein the other flow passage is an outer flow passage which surrounds the one flow passage, which is an inner flow passage, along an entire length of the inner flow passage and at least one fluid access in the combustor liner from the plenum to the outer flow passage is in a downstream end of the combustion chamber.

2. A burner arrangement according to claim 1, wherein the plenum is fluidly connected to a compressor.

3. A burner arrangement according to claim 1 wherein a flow swirler is arranged along at least one of the two flow passages.

4. A burner arrangement according to claim 1 where the inner and outer flow passages are coaxial and each flow passage has a flow exit plane, and that the flow exit plane of the inner flow passage is upstream of the flow exit plane of the outer flow passage.

5. A burner arrangement according to claim 1 wherein the means for fuel injection is arranged inside the inner flow passage.

6. A burner arrangement according to claim 1 wherein the outer flow passage is fluidly connected with the inner flow passage.

7. A burner arrangement according to claim 1 wherein the inner flow passage is surrounded by a channel wall which has an axial downstream edge having a lobed shape.

8. A burner arrangement according to claim 1 wherein the inner flow passage is surrounded by a channel wall which has an axial downstream edge including means for fuel injection.

9. A burner arrangement for producing hot gases to be expanded in a gas turbine, comprising:

a burner inside a plenum, said burner has a fuel lance for fuel injection, an air supply circuit fluidly connected to a compressed air source and a swirler for generating an ignitable fuel/air mixture inside the burner;

a combustion chamber following downstream of said burner having an outlet being fluidly connected to the gas turbine;

a combustor liner arranged between the combustion chamber and a combustor wall and wherein the air supply circuit comprises at least two flow passages which are separate, wherein one of the at least two flow passages is fluidly connected to the plenum and is configured to be fed by a first supply pressure and an other flow passage is configured to be fed by a second supply pressure, wherein the other flow passage is an outer flow passage which surrounds the one flow passage, which is an inner flow passage, along an entire length of the inner flow passage and at least one fluid access in the combustor liner from the plenum to the outer flow passage is in a downstream end of the combustion chamber.

10. A burner arrangement according to claim 9 wherein a flow swirler is arranged along at least one of the two flow passages.

11. A burner arrangement according to claim 9 where the inner and outer flow passages are coaxial and each flow passage has a flow exit plane, and that the flow exit plane of the inner flow passage is upstream of the flow exit plane of the outer flow passage.

12. A burner arrangement according to claim 9 wherein the fuel lance is arranged inside the inner flow passage.

13. A burner arrangement according to claim 9 wherein the outer flow passage is fluidly connected with the inner flow passage.

14. A burner arrangement according to claim 9 wherein the inner flow passage is surrounded by a channel wall which has an axial downstream edge having a lobed shape.

15. A burner arrangement according to claim 9 wherein the inner flow passage is surrounded by a channel wall which has an axial downstream edge including means for fuel injection.

* * * * *